US005490291A

United States Patent [19]

Direnzo

[11] Patent Number: 5,490,291

[45] Date of Patent: Feb. 13, 1996

[54] LACE WORKS FOR BATHROOM SINKS AND SIMILAR ARTICLES

[76] Inventor: Christine J. Direnzo, 17 Tarboro St., Elmont, N.Y. 11003-1706

[21] Appl. No.: 297,407

[22] Filed: Aug. 29, 1994

[51] Int. Cl.[6] ..... E03C 1/33

[52] U.S. Cl. ..... 4/661; 4/636

[58] Field of Search ..... 4/633, 634, 635, 4/636, 654, 661, 901, DIG. 18; 2/918

[56] References Cited

U.S. PATENT DOCUMENTS

| | | | |
|---|---|---|---|
| D. 250,779 | 1/1979 | Smith, II et al. | D33/32 R |
| D. 311,646 | 10/1990 | Thomass | D5/24 |
| 2,845,834 | 8/1958 | Bloch | 87/2 |
| 2,868,604 | 1/1959 | Gibson et al. | 4/636 X |
| 3,408,661 | 11/1968 | Hammond | 4/901 X |
| 3,797,427 | 3/1974 | Metzler | 112/266 |
| 3,996,987 | 12/1976 | Rodriguez | 4/608 X |
| 4,077,072 | 3/1978 | Dezura | 4/558 |

OTHER PUBLICATIONS

American Medical Association, Journal Article, vol. 168, No. 7, Oct. 18, 1958, 1 pg.

*Primary Examiner*—Robert M. Fetsuga
*Attorney, Agent, or Firm*—Richard L. Miller

[57] ABSTRACT

Lace works for a bathroom sink on a counter top of a vanity and similar articles comprising an elongated ribbon of lace fabric. A structure is for removably attaching the elongated ribbon of lace fabric as a decorative border about the rim of the bathroom sink on the counter top of the vanity.

2 Claims, 1 Drawing Sheet

LACE WORKS FOR BATHROOM SINKS AND SIMILAR ARTICLES

BACKGROUND OF THE INVENTION

The instant invention relates generally to lace products and more specifically it relates to lace works for a bathroom sink and similar articles.

Numerous lace products have been provided in prior art that are adapted to contain definite motif patterns used in the manufacture for many different types of articles. For example, U.S. patents numbered U.S. Pat. No. 2,845,834 to Bloch; U.S. Pat. No. 3,797,427 to Metzler; U.S. Pat. No. Des. 250,779 to Smith II et al. and U.S. Pat. No. Des. 311,646 to Thomass all are illustrative of such prior art. While these units may be suitable for the particular purpose to which they address, they would not be as suitable for the purposes of the present invention as heretofore described.

SUMMARY OF THE INVENTION

A primary object of the present invention is to provide a lace works for a bathroom sink and similar articles that will overcome the shortcomings of the prior art devices.

Another object is to provide a lace works for a bathroom sink and similar articles which is a decorative lace border attachable to a household item, such as a vanity and sink that can be detachable therefrom to be reused again or changed for a different pattern.

An additional object is to provide a lace works for a bathroom sink and similar articles that can be fabricated in different styles to accommodate each consumers tastes and decorating needs.

A further object is to provide a lace works for a bathroom sink and similar articles that is simple and easy to use.

A still further object is to provide a lace works for a bathroom sink and similar articles that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

The Figures on the drawings are briefly described as follows.

Figure 1:
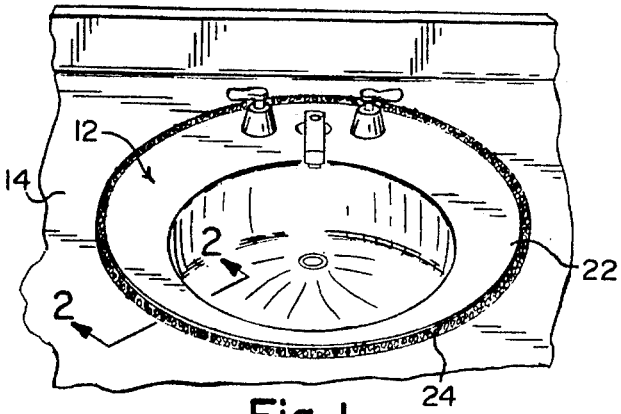
FIG. 1 is a diagrammatic perspective view illustrating a sink with a hook or loop pile fastener material strip attached thereto between a sink rim clamp and a counter top.
Figure 2:
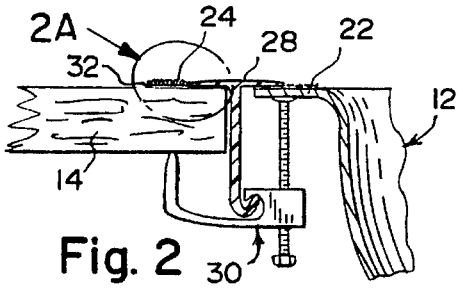
FIG. 2 is an enlarged cross sectional view taken on line 2—2 of FIG. 1.
Figure 3:
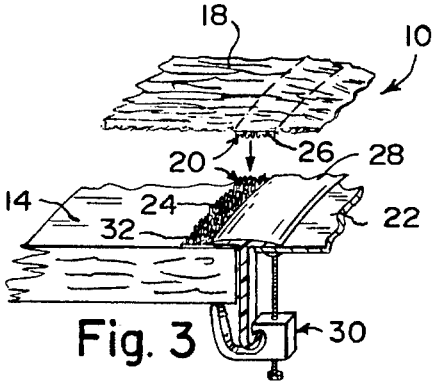
Figure 4:
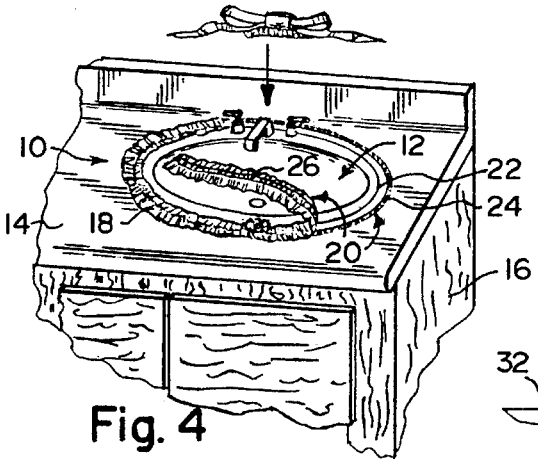
Figure 5:
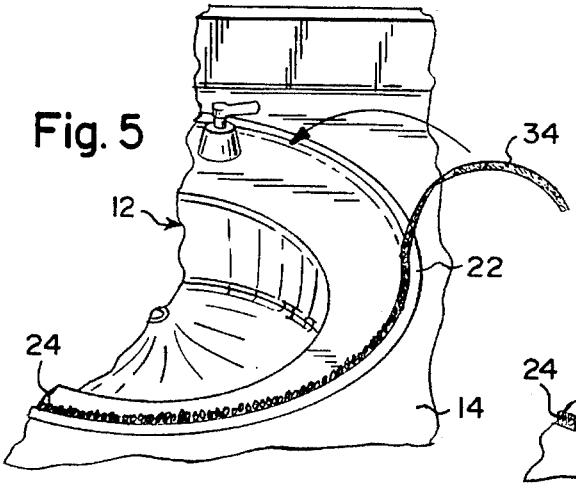
Figure 6:
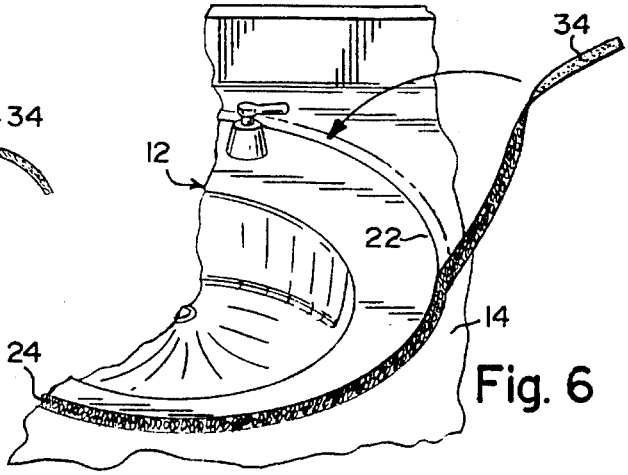

FIG. 2-A is a further enlarged cross sectional view of the area indicated by the dotted circle as indicated by arrow 2-A in FIG. 2;

FIG. 3 is a diagrammatic perspective view with parts broken away illustrating a ribbon of lace fabric with a hook or loop pile fastener material strip about to be secured to the sink;

FIG. 4 is a diagrammatic perspective view illustrating the ribbon of lace fabric partially secured to the sink;

FIG. 5 is a diagrammatic perspective view with parts broken away illustrating a sink and counter top with the hook or loop pile fastener material being attached to the sink rim by adhesive; and FIG. 6 is diagrammatic perspective view with parts broken away illustrating a sink and counter top with the hook or loop pile fastener material being attached to the counter top of the sink rim by adhesive.

DETAILED DESCRIPTION OF THE PREFERRED EMBODIMENTS

Turning now descriptively to the drawings, in which similar reference characters denote similar elements throughout the several views, FIGS. 1 through 6 illustrate lace works 10 for a bathroom sink 12 on a counter top 14 of a vanity 16 and similar articles comprising an elongated ribbon of lace fabric 18. A structure 20 is for detachably securing the elongated ribbon of lace fabric as a decorative border about the rim of the bathroom sink 12 on the counter top 14 of the vanity 16.

The detachable securing structure 20 includes a pair of hook and loop pile fastener material strips 24, 26. The first strip 24 is attached adjacent the perimeter of the rim 22 of the bathroom sink 12, on either side of a flange 28 of a sink rim clamp 30 as may be desired by the user. The second strip 26 is permanently attached to the underside of the elongated ribbon of lace fabric 18.

Figure 2A:
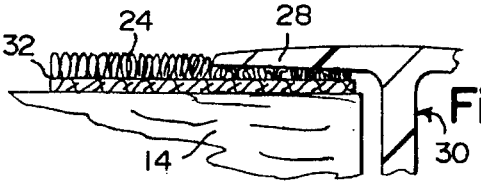

The first fastener material strip 24, as best seen in FIGS. 2, 2A and 3, is attached adjacent a perimeter of the rim 22 of the bathroom sink 12, sandwiched between the flange 28 of the sink rim clamp 30 and an opposing surface of the counter top 14, or in the alternative the rim of the sink 22. An edge portion 32 of the first fastener material strip 24 will be exposed underneath the flange 28 of the sink rim clamp 30, to engage with the second fastener material strip 26 on the elongated ribbon of lace fabric 18.

In FIGS. 5 and 6, the first fastener material strip 24 includes adhesive 34 applied to the underside thereof. In a first instance, shown in FIG. 5, the first fastener material strip 24 can be attached by the adhesive 34 to the rim 22 of the bathroom sink 12 adjacent the perimeter thereof. In a second instance, shown in FIG. 6, the first fastener material strip 24 can be attached by the adhesive 34 to the counter top 14 adjacent the perimeter of the rim 22 of the bathroom sink 12. The first fastener material strip 24 in both instances will engage with the second fastener material strip 26 on the elongated ribbon of lace fabric 18.

OPERATION OF THE INVENTION

To use the lace works 10, a person can simply apply the first fastener material strip 24 between the flange 28 of the sink rim clamp 30 and the counter top 14. The first fastener material strip 24 can also be alternatively attached by the adhesive 34 to the rim 22 or the counter top 14 about the perimeter of the rim 22 of the bathroom sink 12, or to the sink 12 itself per se. The second fastener material strip 26 on the elongated ribbon of lace fabric 18 can now engage with the second fastener material strip 26.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. A method of attaching a lace works for a bathroom sink on a counter top of a vanity including the steps of:

a) securing a strip of a first strip of hook and loop pile fastener material by adhesive means to said sink on said counter top; and b) removably attaching said lace works to said first strip with a second strip of hook and loop pile fastener material which is permanently attached to said lace works.

2. A method of attaching a lace works for a bathroom sink on a counter top of a vanity including the steps of:

a) securing a strip of a first strip of hook and loop pile fastener material by mechanically sandwiching an edge of said first strip between a flange of a sink rim clamp and an opposing surface; and b) removably attaching said lace works to said first strip with a second strip of hook and loop pile fastener material which is permanently attached to said lace works.

* * * * *